US009748648B2

(12) United States Patent
Caille et al.

(10) Patent No.: US 9,748,648 B2
(45) Date of Patent: Aug. 29, 2017

(54) DISTRIBUTED FEEDING DEVICE FOR ANTENNA BEAMFORMING

(71) Applicant: THALES, Neuilly sur Seine (FR)

(72) Inventors: Gerard Caille, Tournefeuille (FR); Michel Sotom, Toulouse (FR)

(73) Assignee: Thales, Courbevoie (FR)

( * ) Notice: Subject to any disclaimer, the term of this patent is extended or adjusted under 35 U.S.C. 154(b) by 585 days.

(21) Appl. No.: 14/261,965

(22) Filed: Apr. 25, 2014

(65) Prior Publication Data

US 2014/0320345 A1 Oct. 30, 2014

(30) Foreign Application Priority Data

Apr. 26, 2013 (FR) ..... 13 00973

(51) Int. Cl.
*H01Q 3/00* (2006.01)
*H01Q 3/40* (2006.01)
*H01Q 3/26* (2006.01)

(52) U.S. Cl.
CPC ..... *H01Q 3/40* (2013.01); *H01Q 3/2676* (2013.01)

(58) Field of Classification Search
CPC ..... H01Q 3/40; H01Q 3/2676
USPC ..... 342/373
See application file for complete search history.

(56) References Cited

U.S. PATENT DOCUMENTS 5,936,588 A 8/1999 Rao et al.
2005/0088339 A1 4/2005 Yap
2011/0110401 A1 * 5/2011 Leong ..... H04B 7/18515 375/211

FOREIGN PATENT DOCUMENTS

WO 9850981 A1 11/1998
WO 2010151484 A1 12/2010
WO WO2010/0151484 * 12/2010

OTHER PUBLICATIONS

Written Opinion from European Patent Office on Application No. 14 165 477.2, Jul. 2014.*
Jesse Butler, et al., "Beam-Forming Matrix Simplifies Design of Electronically Scanned Antennas", Electronic Design, Apr. 12, 1961, pp. 170-173, vol. 9.

(Continued)

*Primary Examiner* — Frank J McGue
(74) *Attorney, Agent, or Firm* — Baker Hostetler LLP

(57) ABSTRACT

A distributed feeding device for antenna beamforming comprises a first distributed feeding circuit comprising P inputs and N outputs, for producing a signal on each of its outputs with a phase shift which is substantially constant between two adjacent outputs, at least one frequency multiplexer connected to at least one input of the said first circuit, a number N of frequency demultiplexers each connected, by their input, to an output of the first circuit and a second distributed feeding means comprising a plurality of inputs, each connected to an output of one of the frequency demultiplexers, and a plurality of outputs, the second distributed feeding means comprising at least one second distributed feeding circuit comprising Q inputs and M outputs, for producing a signal on each output with a phase shift which is substantially constant between two adjacent outputs, the integers P, N, Q and M being equal or distinct.

21 Claims, 11 Drawing Sheets

(56) References Cited

OTHER PUBLICATIONS

Robert J. Mailloux, "Phased Array Antenna Handbook (Second Edition)—Chapter 8—Special Array feeds for Limited Field-of-View and Wideband Arrays", 1993, pp. 379-471, Artech House, Boston/London.

Yu Jian Cheng, "Millimeter-Wave Substrate Integrated Waveguide Multibeam Antenna Based o the Parabolic Reflector Principle", IEEE Transactions on Antennas and Propagation, Sep. 2008, pp. 3055-3058, vol. 56, No. 9.

Zeev Salevsky, et al., "A Novel Photonic Rotman-Lens Design for Radar Phased Array Antennas", IEEE International Conference on Microwaves, Communications, Antennas and Electronics Systems, Nov. 9, 2009, pp. 1-4.

Nelson Jorge Goncalves Fonseca, "These—En Vue De L'Obtention du—Doctorat de L'Universite de Toulouse", Oct. 15, 2010, 253 pages.

Yihong Chen, et al., "A Fully Packaged True Time Delay Module for a K-band Phased Array Antenna system Demonstration", IEEE Photonics Technology Letters, Aug. 2002, pp. 1175-1177, vol. 14, No. 8.

John T. Gallo, et al., "Experimental Demonstration of Optical Guided-Wave Butler Matrices", IEEE Transactions on Microwave Theory and Techniques, Aug. 1, 1997, pp. 1501-1507, vol. 45, No. 8, IEEE Service Center, Piscataway, NJ, USA, XP011036900.

* cited by examiner

DISTRIBUTED FEEDING DEVICE FOR ANTENNA BEAMFORMING

CROSS-REFERENCE TO RELATED APPLICATION

This application claims priority to foreign French patent application No. FR 1300973, filed on Apr. 26, 2013, the disclosure of which is incorporated by reference in its entirety.

FIELD OF THE INVENTION

The invention relates to the field of antenna beamforming arrays for antennal arrays. It relates more precisely to a distributed feeding device for a beamforming array.

The field of the invention is that of antennal arrays, notably for satellite antennas. Satellite antenna arrays have the capacity to generate several antenna beams in various directions of observation. Such multi-beam antennas are used aboard a satellite for telecommunications applications in various frequency bands, for example the Ka band for multimedia applications, the Ku or C bands for point-to-point communication links or else the L or S bands for satellite-based mobile communications. Antenna arrays have the advantage of allowing a reconfiguration of the various beams, notably of their number and of their direction of pointing. In particular, a need exists to design two-dimensional multi-beam antenna arrays, that is to say which are able to generate beams according to two dimensions in space so as to cover a significant illumination zone.

Accordingly, a multi-beam antenna needs to be coupled to a beamforming array tasked with routing the appropriate feeding signal to the various antennal elements of the antenna array with a view to configuring the antenna beams generated by each of the said elements.

The field of the invention is therefore also that of antenna beamforming arrays. A sub-field relates to matrix-like beamforming arrays. An example of such arrays relates to those known by the name of Butler matrices. A Butler matrix is a microwave-frequency passive device composed of hybrid couplers and phase shifters. Such a device is known from the field of antennal arrays and is described notably in the publication "Jesse Butler, Ralph Lowe, *Beam-Forming Matrix Simplifies Design of Electronically Scanned Antennas*, Electronic Design, volume 9, pp. 170-173, 12 Apr. 1961". It makes it possible to obtain, for a microwave-frequency signal produced on one of its inputs, an equi-amplitude distribution of this signal over all the outputs, with a regular phase increment between each consecutive output.

When the output ports of a Butler matrix are connected to the radiating elements of an antennal array, the microwave-frequency signal injected on each input of the matrix is radiated by the antennal array in a predetermined direction and according to a predetermined directional antenna beam. All the antenna beams thus generated via the various radiating elements are regularly spaced and orthogonal. The orthogonality property of the beams is significant for obtaining good mutual isolation of the various pathways.

An advantage of the Butler matrix is that it requires a minimum number of couplers, of the order of $N.(\log_2 N)/2$ instead of $2N(N-1)$, for a conventional beamforming array, with N the number of outputs of the matrix equal to the number of antenna beams to be generated.

Other devices adapted for beamforming are known to the person skilled in the art, such as, for example, Blass matrices, Rotman lenses, or beamformers of 'Pillbox' type.

BACKGROUND

Butler matrices, as well as the equivalent distributed feeding devices, are generally employed for microwave-frequency signals or more generally for electrical signals in the microwave-frequency range. The technology conventionally used to embody such a device is waveguide technology which exhibits the drawback of significant bulkiness. Indeed, for onboard applications, a problem to be solved relates to the miniaturization of such devices since the compactness of an antennal device is a significant advantage especially when the number of antennal elements, and therefore indirectly the number of outputs of the Butler matrix, increases.

Furthermore, for a significant number of antennal elements or of beams to be generated, typically greater than a hundred, the implementation of a Butler matrix becomes very complex since the greater the increase in the number of inputs and outputs, the greater is the impediment to hardware embodiment from the number of components and their arrangement, since the precision required notably in the phase shifts between the outputs of the matrix comes up against the limits of the technology. For this reason, when the number of inputs/outputs of a Butler matrix exceeds 8, it is necessary to use several matrices connected together within a particular arrangement, thereby further increasing the bulkiness of the complete device.

FIG. 1A represents an exemplary distributed feeding device for antenna beamforming according to the prior art. The device according to FIG. 1A is able to generate 64 different signals to feed an antennal array comprising 64 antennal elements disposed, for example, according to a matrix arrangement in a plane.

The device 100 according to FIG. 1A comprises a first assembly of eight distributed feeding circuits 101, . . . , 108 arranged in parallel in a first plane, for example a vertical plane, and a second assembly of eight distributed feeding circuits 111, . . . 118 arranged in parallel in a second plane, orthogonal to the first plane, for example a horizontal plane. Each output of a circuit 101, . . . 108 of the first assembly is connected to an input of a different circuit 111, . . . 118 from the second assembly.

The overall arrangement of the 16 identical feeding circuits makes it possible to obtain a device with 64 inputs I1, . . . , I8, . . . I57, . . . I64 and 64 outputs O1, . . . , O8, . . . O57, . . . O64. The circuits used are for example Butler matrices. The arrangement thus produced makes it possible to obtain a device equivalent to a Butler matrix with 64 inputs and 64 outputs with controllable phase shifts. When one of the inputs of the device is activated, the signals obtained on the outputs of one and the same feeding circuit 111, . . . 118, exhibit phase shifts with a constant increment between two adjacent outputs and the signals obtained on a vertical row consisting of an output of each of the feeding circuits 111, . . . 118, of the second assembly also exhibit phase shifts with a constant increment between two adjacent outputs of the row.

FIG. 1B represents a distributed feeding device 110 of the same type as that of FIG. 1A in which the feeding circuits used are Rotman lenses. These circuits exhibit the particular feature of not being limited to equal numbers of inputs and of outputs.

The device 110 of FIG. 1B comprises a first assembly 111 of six circuits LR1 of the Rotman lens type each comprising 8 inputs I1, . . . I8 and I6 outputs.

The device 110 furthermore comprises a second assembly 112 of 16 circuits LR2 of the Rotman lens type each comprising six inputs and twelve outputs.

The first and the second assembly are arranged so that the outputs of the circuits of the first assembly are connected to the inputs of the circuits of the second assembly.

In this manner, the device 110 makes it possible to feed an antennal array comprising 12*16=192 radiating elements.

A drawback of the devices according to FIGS. 1 and 1*b* is their bulkiness and the number of components required for their embodiment. Indeed, they require a significant number of basic circuits (16 for the case of FIG. 1A, 22 for the case of FIG. 2) each consisting of a plurality of hybrid couplers and of phase shifters.

A problem to be solved consists in decreasing the bulkiness and the number of components required to embody a distributed feeding device for beamforming comprising a number greater than 8, for example equal to 64, of inputs and of outputs.

The invention proposes a distributed feeding device for antenna beamforming whose bulkiness is substantially decreased with respect to the prior art solution described in FIG. 1A.

In its best embodiment, the invention requires only the use of two distributed feeding circuits which are connected so as to generate 64 beams instead of 16 circuits as in the example of FIG. 1A.

SUMMARY OF THE INVENTION

The subject of the invention is a distributed feeding device for antenna beamforming, characterized in that it comprises a first distributed feeding circuit comprising P inputs and N outputs, P and N being two strictly positive integers, which is adapted for producing, when a signal is injected on a single of its inputs, a signal on each of its outputs with a phase shift which is substantially constant between two adjacent outputs, at least one frequency multiplexer connected to at least one input of the said first circuit, a number, equal to the number N of outputs of the said first circuit, of frequency demultiplexers each connected, by their input, to an output of the said first circuit and a second distributed feeding means comprising a plurality of inputs, each connected to an output of one of the said frequency demultiplexers, and a plurality of outputs, the said second distributed feeding means comprising at least one second distributed feeding circuit comprising Q inputs and M outputs, Q and M being two strictly positive integers, which is adapted for producing, when a signal is injected on a single of its inputs, a signal on each of its outputs with a phase shift which is substantially constant between two adjacent outputs, the integers P, N, Q and M being equal or distinct.

According to a particular aspect of the invention, a frequency multiplexer is able to multiplex a plurality of signals on distinct optical carriers.

According to a particular aspect of the invention, a frequency demultiplexer is configured to demultiplex a plurality of optical carriers into at least one group of carriers comprising a single of the optical carriers produced on each input of the said first feeding circuit.

According to a particular aspect of the invention, the second distributed feeding means comprises a number of inputs equal to Q multiplied by N and a number of outputs equal to M multiplied by N, each of its inputs being connected to a distinct output of a frequency demultiplexer.

According to a particular aspect of the invention, the said second distributed feeding means comprises a number equal to N of second distributed feeding circuits with Q inputs and M outputs, adapted for producing, when a signal is injected on a single of their inputs, a signal on each of their outputs with a phase shift which is substantially constant between two adjacent outputs, each of the said second feeding circuits being connected, by its Q inputs, to Q outputs of one and the same frequency demultiplexer.

According to a particular aspect of the invention, the said second distributed feeding means comprises a number equal to N/2 of second distributed feeding circuits with Q inputs and M outputs and adapted for producing, when a signal is injected on a single of their inputs, a signal on each of their outputs with a phase shift which is substantially constant between two adjacent outputs, the said second feeding means furthermore comprising at least one polarization-combining element connected, by its output, to an input of one of the said second distributed feeding circuits and being able to combine a first signal delivered by an output of a first frequency demultiplexer having a first polarization and a second signal delivered by an output of a second frequency demultiplexer having a second polarization, different from the first polarization, the said second feeding means furthermore comprising at least one polarization-separating element connected, by its input, to an output of one of the said second distributed feeding circuits and being able to separate a first signal having a first polarization from a second signal having a second polarization, different from the first polarization.

According to a particular aspect of the invention, the second polarization is orthogonal to the first polarization.

According to a particular aspect of the invention, the first polarization is horizontal and the second polarization is vertical.

According to a particular aspect of the invention, the said second distributed feeding means comprises a single distributed feeding circuit with Q inputs and M outputs which is adapted for producing, when a signal is injected on a single of its inputs, a signal on each of its outputs with a phase shift which is substantially constant between two adjacent outputs, a means for frequency translating the optical signals delivered by each frequency demultiplexer so that they occupy different frequency bands, at least one second frequency multiplexer for multiplexing together the signals, delivered by each of the said frequency demultiplexers, emitted on the same optical carriers, and at least one second frequency demultiplexer, connected to an output of the said single feeding circuit, for demultiplexing the frequency-translated signals.

According to a particular aspect of the invention, the said frequency bands are adjacent.

According to a particular aspect of the invention, the said second distributed feeding means furthermore comprises a means for modifying the polarization of the signals delivered by a first frequency demultiplexer so that the signals delivered by two distinct first demultiplexers are polarized differently and a means for modifying the polarization of the signals delivered at the output of the said distributed feeding circuit so that they all have the same polarization.

According to a particular aspect of the invention, the theoretical transfer function of the said first and second distributed feeding circuits is an orthogonal or unit matrix.

According to a particular embodiment of the invention, the distributed feeding device furthermore comprises a second distributed feeding circuit paired with the first distributed feeding circuit and configured with different polarization from that of the said first distributed feeding circuit.

According to a particular aspect of the invention, the said first and second distributed feeding circuits are of the Blass matrices or Rotman lenses or "Pillbox" devices type.

According to a particular aspect of the invention, the number of inputs P and of outputs N of the first distributed feeding circuit are equal to one another and to the number of inputs Q and of outputs M of a second distributed feeding circuit of the second distributed feeding means.

According to a particular aspect of the invention, the said first and second distributed feeding circuits are of the Butler matrix type.

According to a particular aspect of the invention, the said first and second distributed feeding circuits are optical integrated circuits.

According to a particular aspect of the invention, the said first distributed feeding circuit is disposed in a plane substantially orthogonal to the plane of the said second distributed feeding circuit.

The subject of the invention is also an antenna beamforming array comprising a distributed feeding device according to the invention for feeding at least one antennal element of an antenna array.

According to a particular aspect of the antenna beamforming array according to the invention, it comprises first means for modulating at least one electrical signal at a microwave frequency on an optical carrier and injecting it on at least one input of the said distributed feeding device and second means for receiving at least one signal produced on at least one of the outputs of the said distributed feeding device and converting it into an electrical signal intended to feed at least one antennal element of an antenna array.

According to a particular aspect of the antenna beamforming array according to the invention, the optical carriers intended to be injected at the input of the said distributed feeding device are grouped together, each group of carriers being injected on the inputs of a distinct multiplexer, a group comprising a plurality of adjacent carriers or a plurality of equidistributed carriers in the total band occupied by the carriers as a whole.

BRIEF DESCRIPTION OF THE DRAWINGS

Other characteristics and advantages of the present invention will become more apparent on reading the description which follows in relation to the appended drawings which represent.

DETAILED DESCRIPTION

Figure 2:
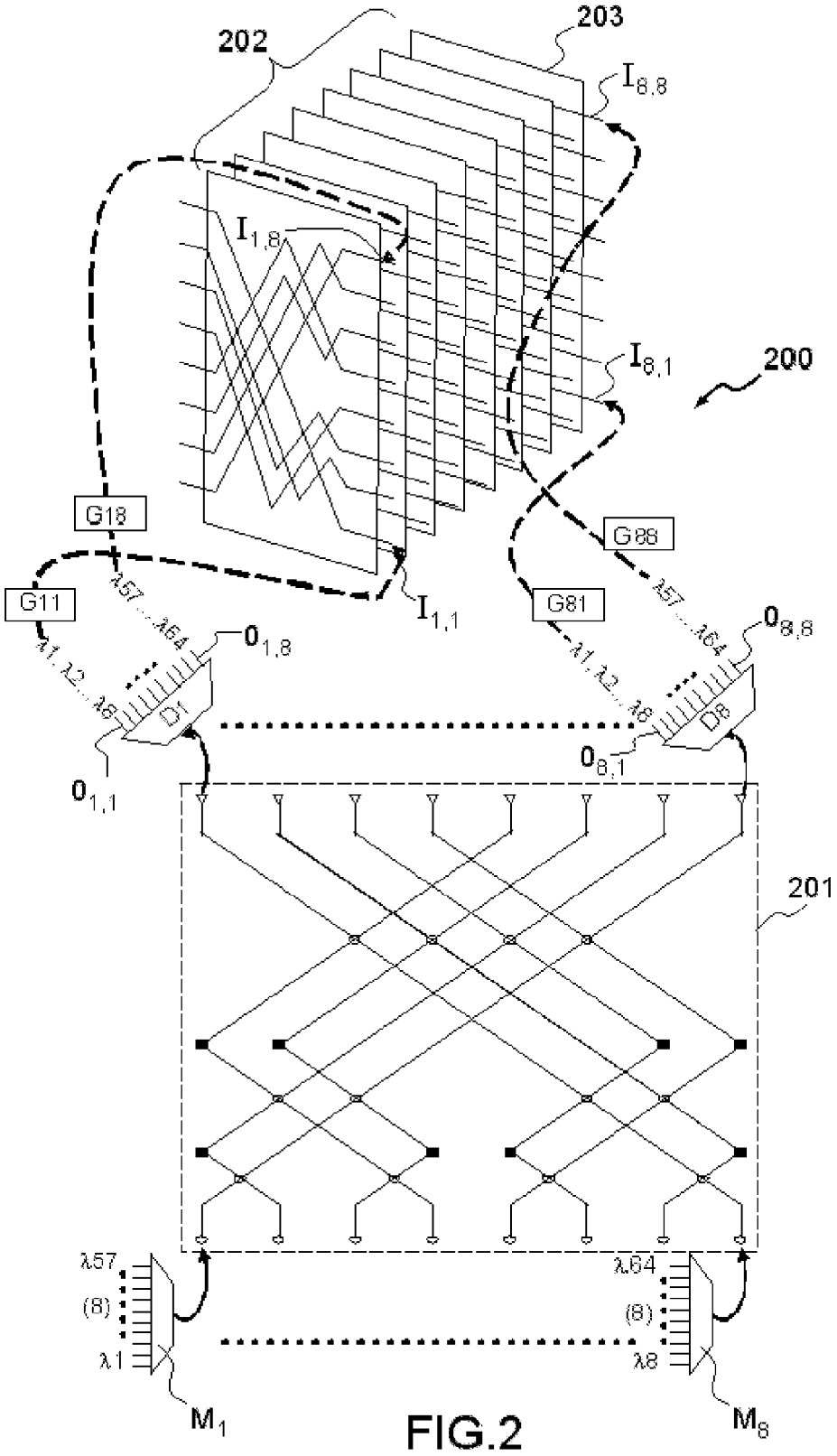

FIG. 2 represents a diagram of an exemplary distributed feeding device according to a first embodiment of the invention.

In the example of FIG. 2, the device according to the invention comprises 64 inputs and 64 outputs and is adapted for the formation of 64 distinct antenna beams. It differs from the device of the prior art presented in FIG. 1A in that the first assembly of eight distributed feeding circuits is replaced with a first single distributed feeding circuit 201, with eight inputs and eight outputs, associated with eight frequency multiplexers M1, . . . M8 and 8 frequency demultiplexers D1, . . . D8.

A frequency multiplexer M1, . . . M8 comprises eight distinct inputs for receiving eight signals transmitted on eight distinct frequency carriers and an output, connected to an input of the first distributed feeding circuit 201. Its function consists in multiplexing a plurality of signals on distinct carriers into a multi-carrier single signal.

A frequency demultiplexer D1, . . . D8 comprises an input, connected to an output of the first distributed feeding circuit 201, and eight outputs for delivering eight signals on distinct carriers, on the basis of the multi-carrier input signal.

Each output $O_{1,1}$, $O_{1,8}$, $O_{8,1}$, $O_{8,8}$ of a frequency demultiplexer is connected to a distinct input $I_{1,1}$, $I_{1,8}$, $I_{8,1}$, $I_{8,8}$ of an assembly 202 of eight distributed feeding circuits 203 with eight inputs and eight outputs each.

Figure 1A:
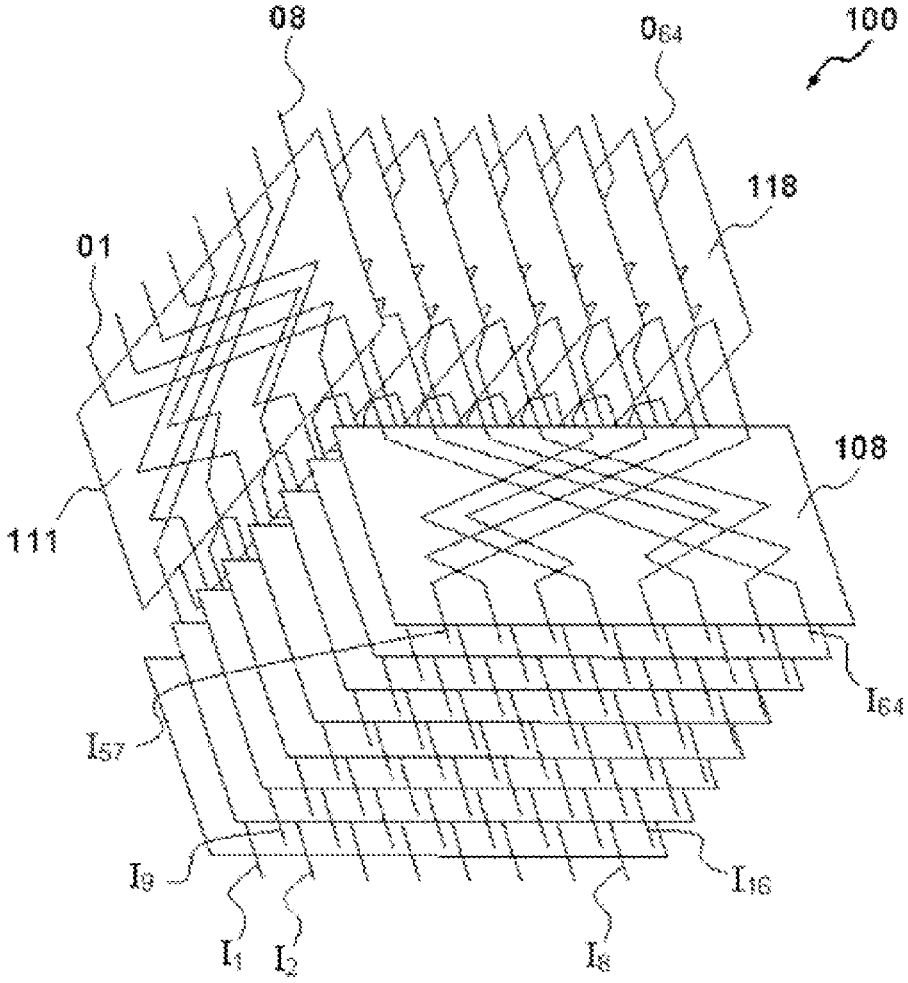
FIG. 1A, a diagram of a first distributed feeding device according to the prior art comprising 16 unitary circuits of Butler matrices type, FIG. 1B, a diagram of a second distributed feeding device according to the prior art comprising 22 unitary circuits of Rotman lens type, FIG. 2, a diagram of a first variant embodiment of a distributed feeding device according to the invention, FIG. 3A, a diagram identical to that of FIG. 2 with a variant arrangement of the optical carriers at input, FIG. 3B, a diagram illustrating the operation of a wavelengths-interleaving multiplexer employed in the device of FIG. 3A, FIG. 4, a diagram of a second variant embodiment of a distributed feeding device according to the invention, FIG. 5, a diagram of a third variant embodiment of a distributed feeding device according to the invention, FIGS. 6*a* and 6*b*, two diagrams illustrating two variant embodiments of the modulation of an electrical signal on optical carrier, FIG. 7A, a diagram of a beamforming array according to the invention, FIG. 7B, a diagram of a second variant embodiment of a beamforming array according to the invention, FIG. 8, a diagram of a sub-variant of the first variant embodiment of a distributed feeding device according to the invention, such as described in FIG. 2.
Figure 1B:
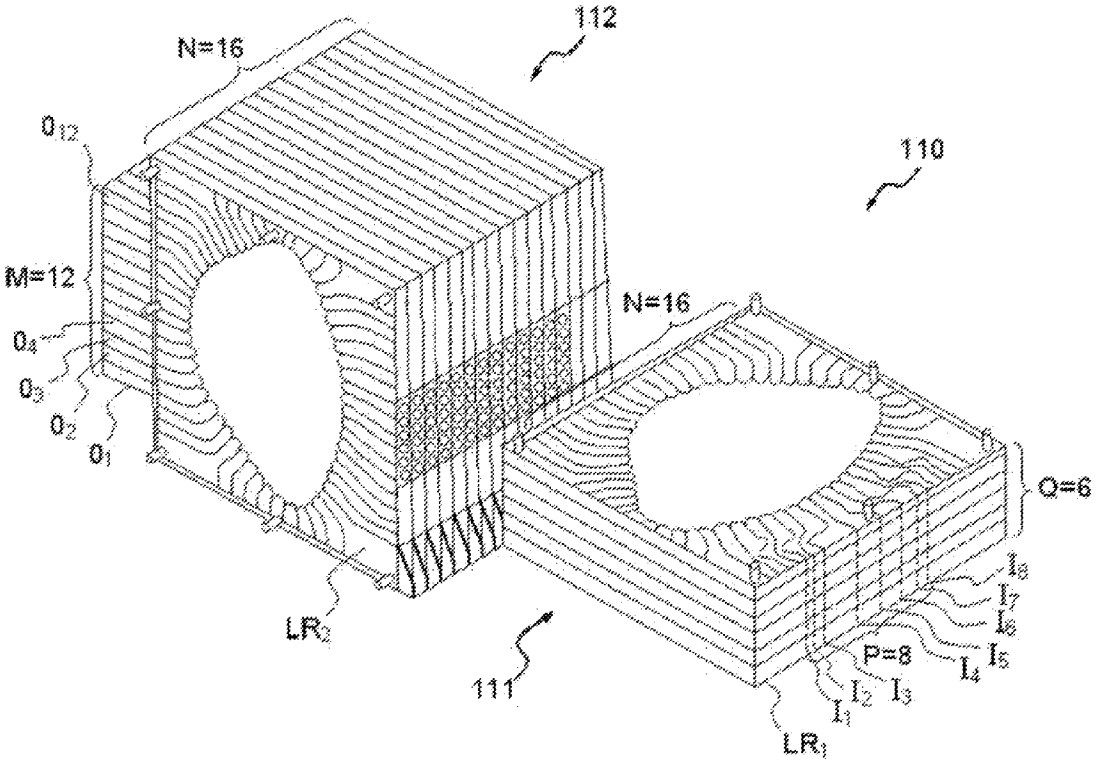

The device according to the invention, presented in FIG. 2, thus comprises nine distributed feeding circuits 201,203 in comparison to the 16 circuits required to embody the device according to the prior art described in FIG. 1A.

The nine circuits 201,203 are identical and are adapted for producing, when a signal is injected on a single input, a signal on each of the outputs with a phase shift which is substantially constant between two adjacent outputs. For example, for the case of a circuit with eight inputs and eight outputs, the phase shift obtained at output is a multiple of PI/8. Furthermore, the theoretical transfer function of such a circuit is an orthogonal matrix, that is to say it satisfies the relation, $\underline{VOi}.\underline{VOj}^*\underline{VOj}.\underline{VOi}^*=0$, where VOi and VOj are the column vectors (here with 8 terms) composed of the values of the complex amplitudes of the 8 output signals, and $\underline{VO}^*$ designates the conjugate transpose operator of $\underline{VO}$, a row matrix composed of the complex conjugates of the values present in $\underline{VO}$.

A significant particular case of the orthogonal matrices is those of the beamformers which theoretically exhibit no loss (other than the very low in-line losses, which are neglected in the mathematical formulations). In this case their transfer matrix T is unitary, that is to say it satisfies the relation $T.T^*=T^*.T=Id$, with Id the identity matrix and $T^*$ the conjugate transpose matrix also called the Hermitian conjugate of the matrix T.

An exemplary distributed feeding circuit is a Butler matrix or any equivalent device comprising N inputs and N outputs and adapted for the formation of multiple antenna beams, mutually orthogonal and thus exhibiting reduced losses.

The example described in FIG. 2 can be generalized to any device with $N^2$ inputs and $N^2$ outputs, with N an integer equal to a power of two. In this general case, the device according to the invention comprises N+1 distributed feeding circuits, N frequency multiplexers with N inputs and an output and N frequency demultiplexers with an input and N outputs.

We will see further on in the description that the device of FIG. 2 can further be broadened to any device comprising P×N inputs and Q×M outputs, where P, N, Q and M are strictly positive integers.

In order to limit the bulkiness of a distributed feeding device according to the invention, in particular when the number of inputs/outputs is appreciably large, such a device can be embodied in PIC ("Photonic Integrated Circuit") technology.

In this case, the input signals of the device 200 are optical signals transmitted on 64 distinct carriers identified by their respective wavelengths $\lambda_1, \ldots \lambda_8, \ldots \lambda_{57}, \ldots \lambda_{64}$.

Each frequency demultiplexer D1, . . . D8 is configured to demultiplex the various optical carriers received as output from the first feeding circuit 201 so that, on an output of a demultiplexer, only a single of the optical carriers produced at each input of the first feeding circuit 201 is isolated.

The following table gives an exemplary arrangement of the optical carriers on the various inputs of the eight multiplexers M1, . . . M8.

| Multiplexer | Optical Carriers |
|---|---|
| M1 | $\lambda_1, \lambda_9, \lambda_{17}, \lambda_{25}, \lambda_{33}, \lambda_{41}, \lambda_{49}, \lambda_{57}$ |
| M2 | $\lambda_2, \lambda_{10}, \lambda_{18}, \lambda_{26}, \lambda_{34}, \lambda_{42}, \lambda_{50}, \lambda_{58}$ |
| M3 | $\lambda_3, \lambda_{11}, \lambda_{19}, \lambda_{27}, \lambda_{35}, \lambda_{43}, \lambda_{51}, \lambda_{59}$ |
| M4 | $\lambda_4, \lambda_{12}, \lambda_{20}, \lambda_{28}, \lambda_{36}, \lambda_{44}, \lambda_{52}, \lambda_{60}$ |
| M5 | $\lambda_5, \lambda_{13}, \lambda_{21}, \lambda_{29}, \lambda_{37}, \lambda_{45}, \lambda_{53}, \lambda_{61}$ |
| M6 | $\lambda_6, \lambda_{14}, \lambda_{22}, \lambda_{30}, \lambda_{38}, \lambda_{46}, \lambda_{54}, \lambda_{62}$ |
| M7 | $\lambda_7, \lambda_{15}, \lambda_{23}, \lambda_{31}, \lambda_{39}, \lambda_{47}, \lambda_{55}, \lambda_{63}$ |
| M8 | $\Lambda_8, \lambda_{16}, \lambda_{24}, \lambda_{32}, \lambda_{40}, \lambda_{48}, \lambda_{56}, \lambda_{64}$ |

By applying the aforementioned arrangement, the following table gives the indices of the wavelengths of the optical carriers received on each output, indexed from 1 to 8, of each frequency demultiplexer D1, . . . D8.

| Output of a demultiplexer D1, . . . D8 | Optical Carriers |
|---|---|
| 1 | $\lambda_1, \lambda_2, \lambda_3, \lambda_4, \lambda_5, \lambda_6, \lambda_7, \lambda_8$ |
| 2 | $\lambda_9, \lambda_{10}, \lambda_{11}, \lambda_{12}, \lambda_{13}, \lambda_{14}, \lambda_{15}, \lambda_{16}$ |
| 3 | $\lambda_{17}, \lambda_{18}, \lambda_{19}, \lambda_{20}, \lambda_{21}, \lambda_{22}, \lambda_{23}, \lambda_{24}$ |
| 4 | $\lambda_{25}, \lambda_{26}, \lambda_{27}, \lambda_{28}, \lambda_{29}, \lambda_{30}, \lambda_{31}, \lambda_{32}$ |
| 5 | $\lambda_{33}, \lambda_{34}, \lambda_{35}, \lambda_{36}, \lambda_{37}, \lambda_{38}, \lambda_{39}, \lambda_{40}$ |
| 6 | $\lambda_{41}, \lambda_{42}, \lambda_{43}, \lambda_{44}, \lambda_{45}, \lambda_{46}, \lambda_{47}, \lambda_{48}$ |
| 7 | $\lambda_{49}, \lambda_{50}, \lambda_{51}, \lambda_{52}, \lambda_{53}, \lambda_{54}, \lambda_{55}, \lambda_{56}$ |
| 8 | $\lambda_{57}, \lambda_{58}, \lambda_{59}, \lambda_{60}, \lambda_{61}, \lambda_{62}, \lambda_{63}, \lambda_{64}$ |

Figure 3A:
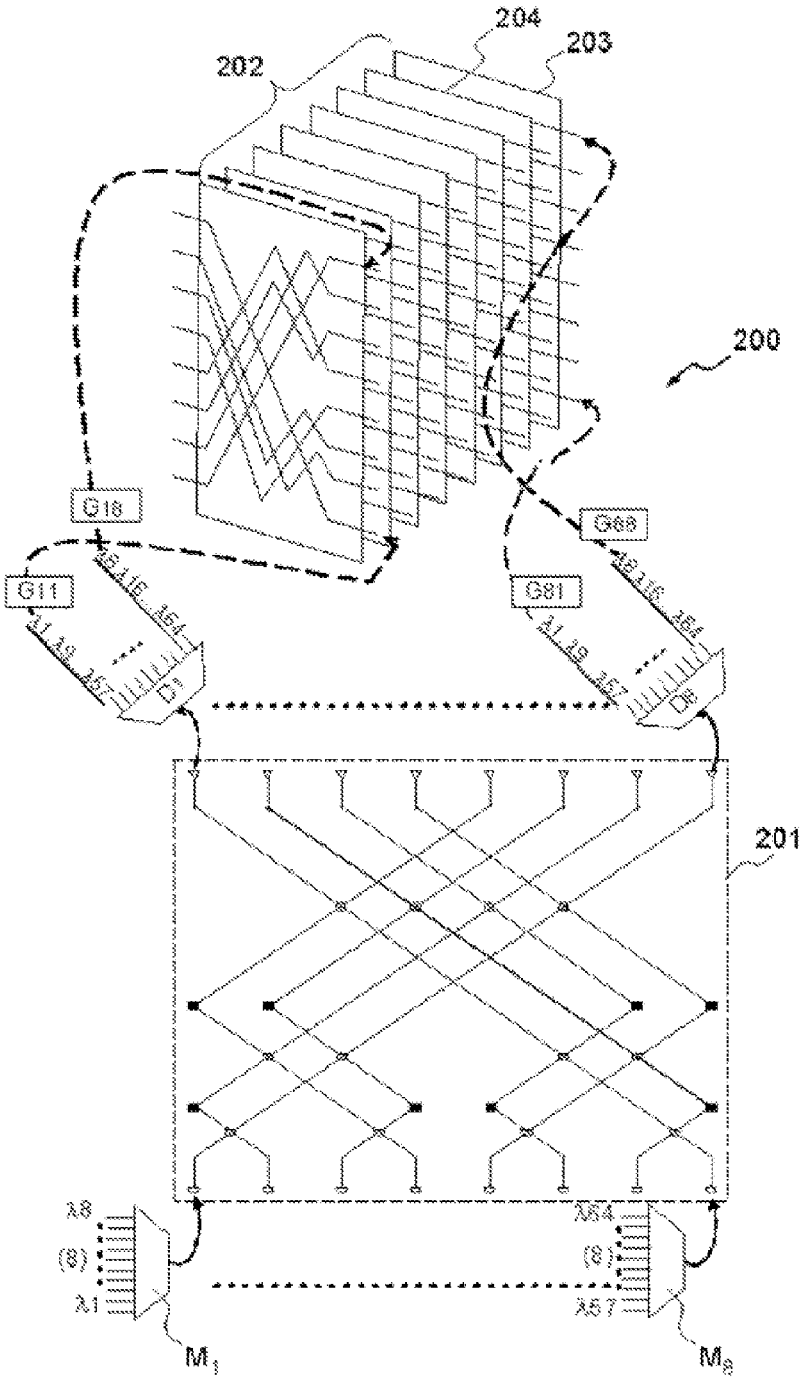

FIG. 3A illustrates, for the same distributed feeding device 200 according to the invention, a different arrangement of the optical carriers on the 64 inputs of the 8 multiplexers M1, . . . M8.

This arrangement is given in the following table.

| Multiplexer | Optical Carriers |
|---|---|
| M1 | $\lambda_1, \lambda_2, \lambda_3, \lambda_4, \lambda_5, \lambda_6, \lambda_7, \lambda_8$ |
| M2 | $\lambda_9, \lambda_{10}, \lambda_{11}, \lambda_{12}, \lambda_{13}, \lambda_{14}, \lambda_{15}, \lambda_{16}$ |

-continued

| Multiplexer | Optical Carriers |
|---|---|
| M3 | $\lambda_{17}, \lambda_{18}, \lambda_{19}, \lambda_{20}, \lambda_{21}, \lambda_{22}, \lambda_{23}, \lambda_{24}$ |
| M4 | $\lambda_{25}, \lambda_{26}, \lambda_{27}, \lambda_{28}, \lambda_{29}, \lambda_{30}, \lambda_{31}, \lambda_{32}$ |
| M5 | $\lambda_{33}, \lambda_{34}, \lambda_{35}, \lambda_{36}, \lambda_{37}, \lambda_{38}, \lambda_{39}, \lambda_{40}$ |
| M6 | $\lambda_{41}, \lambda_{42}, \lambda_{43}, \lambda_{44}, \lambda_{45}, \lambda_{46}, \lambda_{47}, \lambda_{48}$ |
| M7 | $\lambda_{49}, \lambda_{50}, \lambda_{51}, \lambda_{52}, \lambda_{53}, \lambda_{54}, \lambda_{55}, \lambda_{56}$ |
| M8 | $\lambda_{57}, \lambda_{58}, \lambda_{59}, \lambda_{60}, \lambda_{61}, \lambda_{62}, \lambda_{63}, \lambda_{64}$ |

By applying the aforementioned arrangement, the following table gives the indices of the wavelengths of the optical carriers received on each output, indexed from 1 to 8, of each frequency demultiplexer D1, . . . D8.

| Output of a demultiplexer D1, . . . D8 | Optical Carriers |
|---|---|
| 1 | $\lambda_1, \lambda_9, \lambda_{17}, \lambda_{25}, \lambda_{33}, \lambda_{41}, \lambda_{49}, \lambda_{57}$ |
| 2 | $\lambda_2, \lambda_{10}, \lambda_{18}, \lambda_{26}, \lambda_{34}, \lambda_{42}, \lambda_{50}, \lambda_{58}$ |
| 3 | $\lambda_3, \lambda_{11}, \lambda_{19}, \lambda_{27}, \lambda_{35}, \lambda_{43}, \lambda_{51}, \lambda_{59}$ |
| 4 | $\lambda_4, \lambda_{12}, \lambda_{20}, \lambda_{28}, \lambda_{36}, \lambda_{44}, \lambda_{52}, \lambda_{60}$ |
| 5 | $\lambda_5, \lambda_{13}, \lambda_{21}, \lambda_{29}, \lambda_{37}, \lambda_{45}, \lambda_{53}, \lambda_{61}$ |
| 6 | $\lambda_6, \lambda_{14}, \lambda_{22}, \lambda_{30}, \lambda_{38}, \lambda_{46}, \lambda_{54}, \lambda_{62}$ |
| 7 | $\lambda_7, \lambda_{15}, \lambda_{23}, \lambda_{31}, \lambda_{39}, \lambda_{47}, \lambda_{55}, \lambda_{63}$ |
| 8 | $\Lambda_8, \lambda_{16}, \lambda_{24}, \lambda_{32}, \lambda_{40}, \lambda_{48}, \lambda_{56}, \lambda_{64}$ |

The device 200 according to the invention makes it possible to generate, on its 64 outputs, 64 distinct feeding signals with a phase shift which is substantially constant between two adjacent outputs of a distributed feeding circuit 203 of the second assembly 202 but also with a phase shift which is substantially constant between two outputs of the same index of two adjacent circuits 203,204 of the second assembly 202. By feeding an antennal array having 64 elements, disposed for example according to a matrix arrangement with 8 rows and 8 columns, it is possible to generate 64 two-dimensional antenna beams in directions that are parametrizable by the phase shift imparted on the output signals of the device 200.

The arrangement of optical carriers described in FIG. 3A presents the advantage of allowing the use of an optical interleaver or wavelength interleaver to embody the frequency multiplexers M1, . . . M8. The periodic interleaving of non-adjacent optical carriers is indeed simpler to implement than the multiplexing of adjacent optical carriers in a restricted band of frequencies or wavelengths.

Figure 3B:
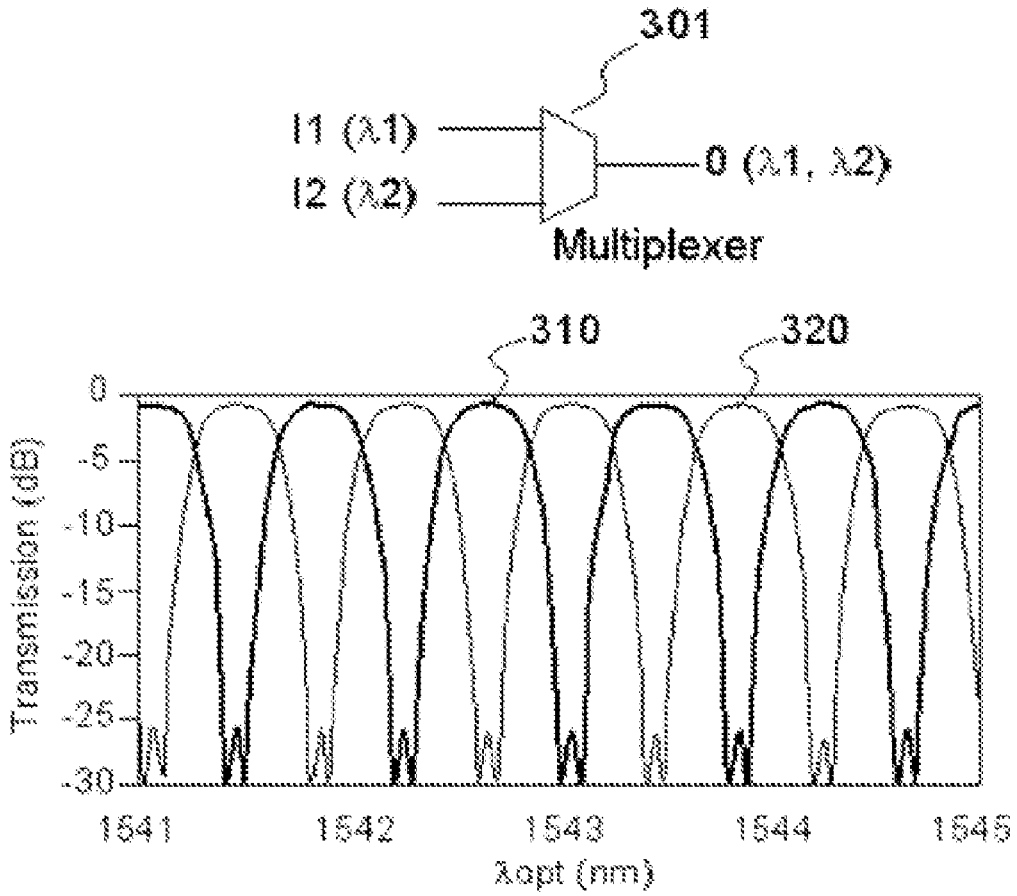

FIG. 3B illustrates the operating principle of an optical wavelength interleaver 301 for the particular case of two wavelengths. The principle can readily be extended to an optical interleaver with 8 inputs like those employed in the device of FIG. 3A. On the left of FIG. 3B is represented a diagram of the spectrum at the output of an optical interleaver 301. This spectrum comprises two sets of interleaved optical carriers 310,320. Likewise the frequency demultiplexers D1, . . . D8 can be implemented by using the same optical interleavers used in inverse function.

Detailed examination of the above tables shows that the two proposed arrangements exchange between multiplexers and demultiplexers those where periodic interleavers can be used, and those where it is necessary to multiplex/demultiplex sub-bands consisting of 8 adjacent carriers (with their modulations).

Other choices are possible regarding the order of assignment of the optical wavelengths to the inputs of the multiplexers M1 to M8, but the two solutions presented in the above tables lend themselves most easily to a concrete setup, either in the form of discrete devices, or by integrated design on PIC optical circuit.

Figure 4:
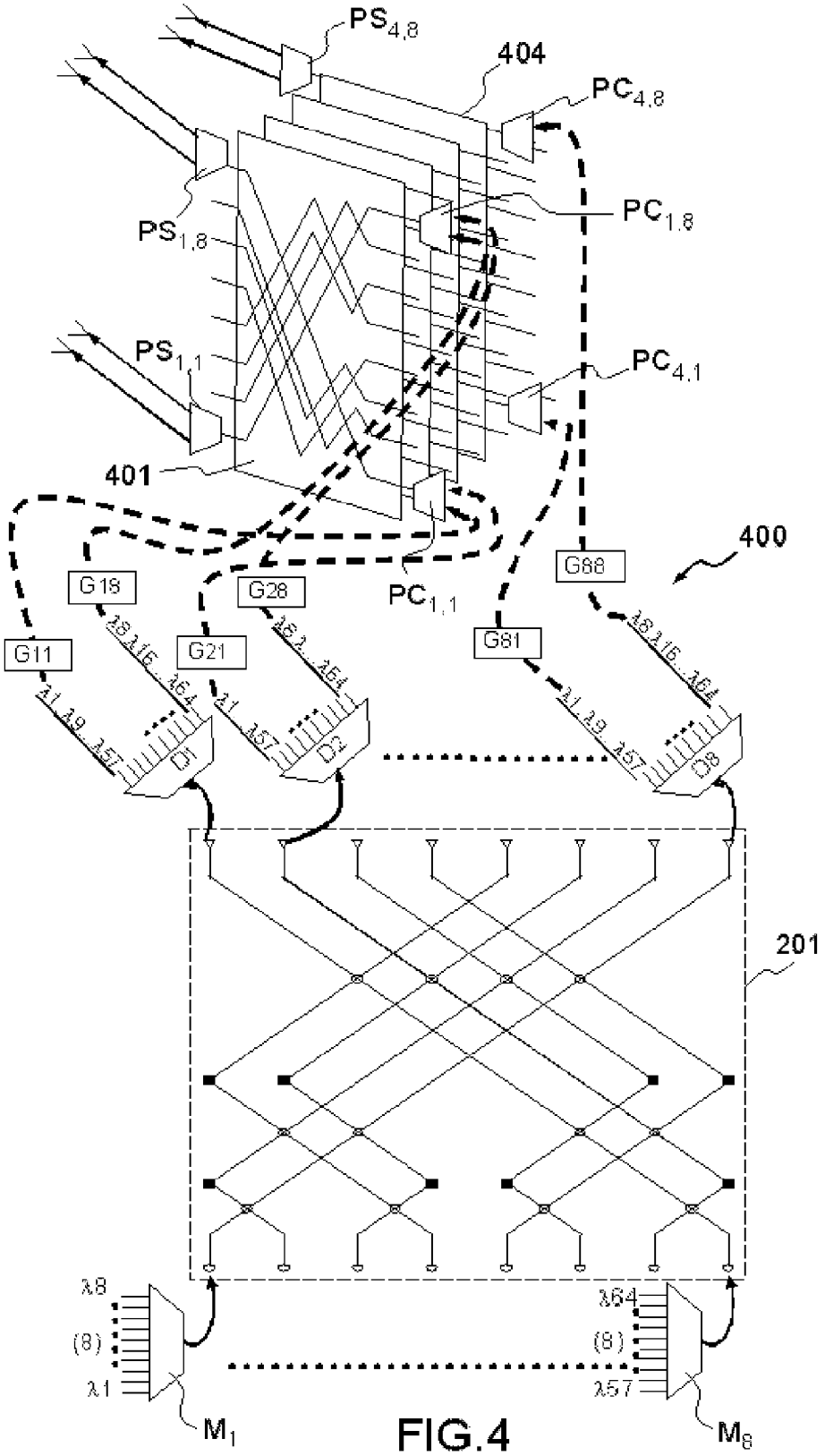

FIG. 4 represents a diagram of a second variant embodiment of the device according to the invention.

According to this second variant, the overall bulkiness of the device is further improved by decreasing the number of distributed feeding circuits of the second assembly 202 from eight to four.

Accordingly, the device 400 according to the second variant embodiment of the invention comprises, for each input of a feeding circuit 401, a polarization-combining element $PC_{1,1}$, $PC_{4,1}$, $PC_{4,8}$, $PC_{1,8}$ for combining two signals of different polarizations, for example two orthogonal polarizations such as a horizontal polarization and a vertical polarization.

Each polarization-combining element $PC_{1,1}$, $PC_{4,1}$, $PC_{4,8}$, $PC_{1,8}$ is designed to combine a first signal delivered by an output of a first frequency demultiplexer D1 and a second signal delivered by an output of a second frequency demultiplexer D2, for example adjacent to the first demultiplexer D1. The polarizations of the said first and second signals are modified so that the output signal of the said polarization combiner is composed of the combination of the first signal having a first polarization and of the second signal having a second polarization, orthogonal to the first. In this manner, the number of distributed feeding circuits 401 required is decreased by two.

The device 400 according to the second variant embodiment of the invention furthermore comprises, for each output of a feeding circuit 401, a polarization-separating element $PS_{1,1}$, $PS_{4,1}$, $PS_{4,8}$, $PS_{1,8}$ for carrying out the operation inverse to that performed by a polarization-combining element. Stated otherwise, a polarization-separating element $PS_{1,1}$, $PS_{4,1}$, $PS_{4,8}$, $PS_{1,8}$ is adapted for separating two signals of distinct polarizations intended to feed two distinct antennal elements of one and the same array.

Figure 5:
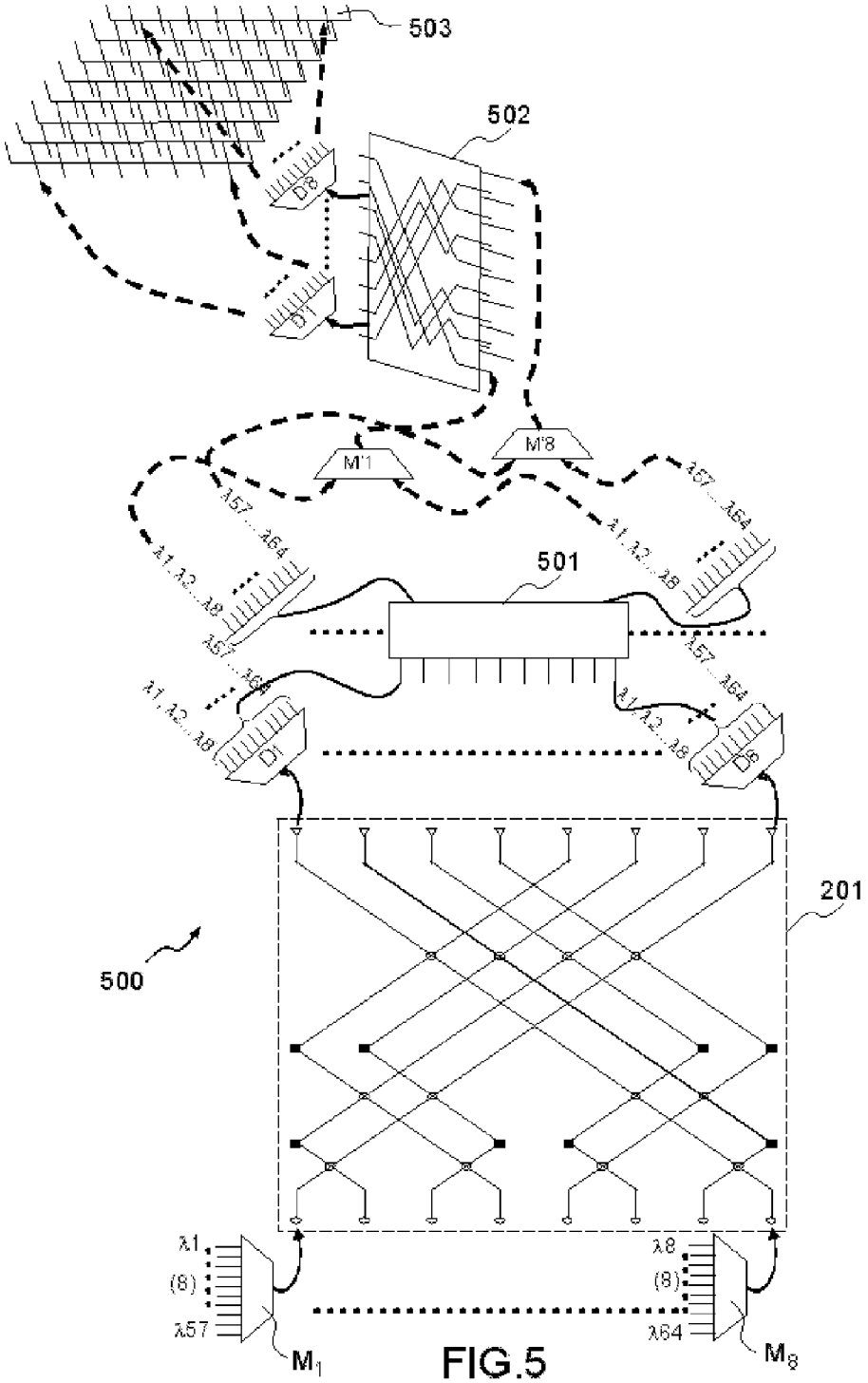

FIG. 5 represents a diagram of a third variant embodiment of the device according to the invention.

In this third variant, the overall bulkiness of the device is further improved by decreasing the number of distributed feeding circuits of the second assembly 202 from four to a single circuit 502.

To obtain this result, the distributed feeding device 500 furthermore comprises a means 501 for effecting a frequency translation (or equivalently a wavelength translation) of the signals obtained as output from the frequency demultiplexers D1, . . . D8. Stated otherwise, the group of optical carriers obtained on the assembly of the eight outputs of a demultiplexer D1 is translated by a frequency gap equal to $kD_f$ where k is an integer varying from 0 to 7 and $D_f$ is at least equal to the width of the frequency band occupied by the assembly of 64 optical carriers injected as input to the device 500 according to the invention. In this manner, the signals arising from the eight frequency demultiplexers D1, . . . D8 are translated over distinct frequency bands. The overall spectral occupancy is then multiplied by eight and requires 64×8=512 distinct optical carriers.

The frequency-translated signals are thereafter distributed over the eight inputs of eight frequency multiplexers M'1, . . . M'8 in the following manner. The eight signals arising from the first output of each frequency demultiplexer D1, . . . D8 are routed to the eight inputs of the first multiplexer M'1. The eight signals arising from the second output of each frequency demultiplexer D1, . . . D8 are routed to the eight inputs of the second multiplexer M'2 and so on and so forth. Each of the eight frequency multiplexers M'1, . . . M'8 is connected, by its output, to an input of the distributed feeding circuit 502 so that the latter receives on each of its inputs the contributions corresponding to a given group of optical carriers for which the signals arising from each demultiplexer D1, . . . D8 are differentiated through the frequency translation effected.

In this manner, the use of eight distinct distributed amplification circuits to convey the signals arising from the eight distinct demultiplexers is avoided.

Each output of the distributed feeding circuit 502 is connected to the input of a second frequency demultiplexer D'1, . . . D'8 so as to demultiplex the 64 optical carriers injected as input to the device 502 according to the invention and to feed an antennal array 503 composed of 64 distinct elements.

The example given in FIG. 5 relates to a device allowing the feeding of an array with 64 antennal elements but it is possible to design an equivalent device with $N^2$ inputs and outputs with N an integer equal to a power of two. The two distributed feeding circuits 201,502 are identical and comprise N inputs and outputs, the multiplexers and demultiplexers employed comprise respectively N inputs and N outputs. The number of optical carriers required to embody the device 500 according to the variant embodiment of FIG. 5 is equal to $N^3$.

In a variant embodiment of the device according to FIG. 5, the number of optical carriers can be decreased to $N^3/2$, i.e. 256 in the case where N is equal to 8. Accordingly, the means 501 for translating optical frequencies is furthermore adapted for modifying the polarization of the signals so that two groups of signals arising from two demultiplexers D1,D2 are polarized according to two different polarizations, for example two orthogonal polarizations such as a vertical polarization and a horizontal polarization. In this manner, the total spectral occupancy is decreased by a factor of two with respect to the previous case, the total required number of optical carriers goes to $N^3/2$.

The frequency demultiplexers D'1, . . . D'8 connected at the output of the second distributed feeding circuit 502 are furthermore adapted for modifying the polarization of the signals so that they all exhibit the same polarization on input to the antennal array. However, in the case where the signals injected are electrical signals modulated on optical carrier, The device 200,400,500 according to the invention can be fed by microwave-frequency signals, signals on optical carrier but also by microwave-frequency signals, or microwaves, modulated on optical carrier.

Figure 6A:
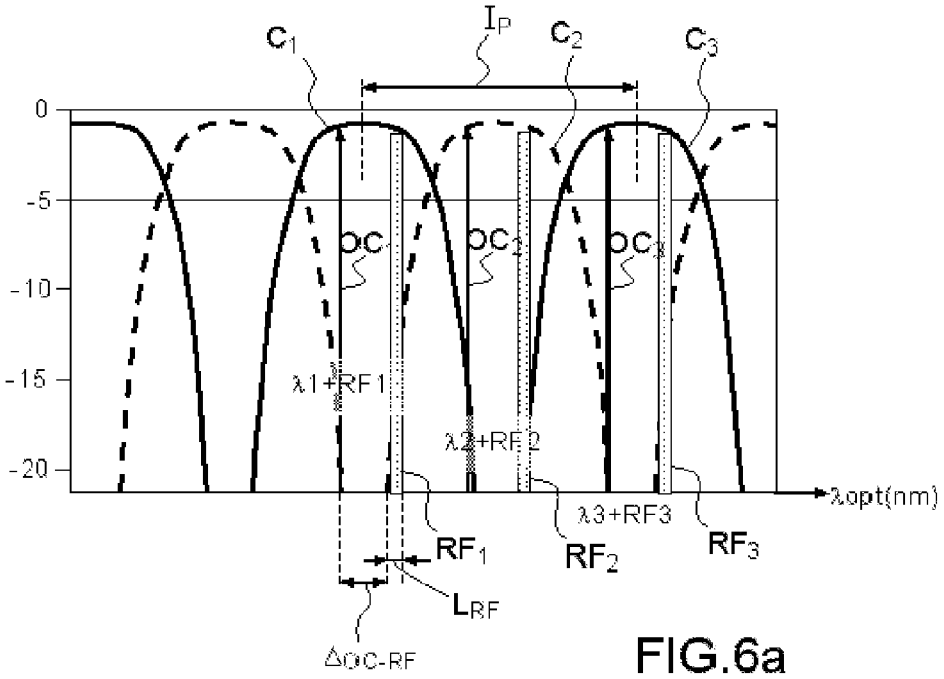
Figure 6B:
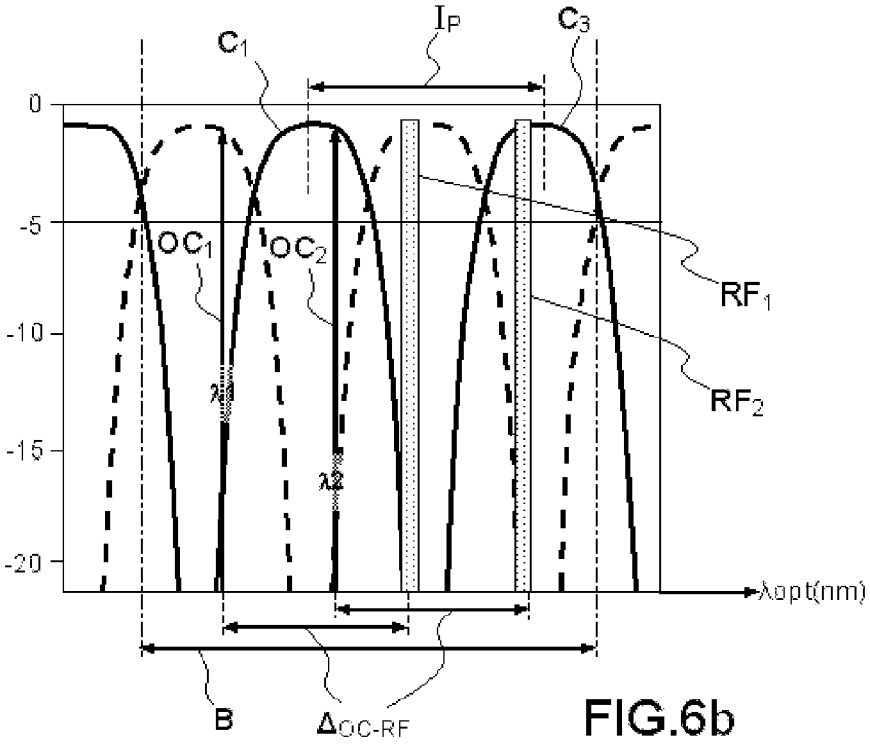

FIGS. 6*a* and 6*b* illustrate the spectral occupancy of the signals injected as input to the device according to the invention in the case of microwave-frequency signals modulated on optical carrier.

The diagrams of FIGS. 6*a* and 6*b* represent the spectrum of the input signals, in decibels, as a function of the wavelength $\lambda_{opt}$ expressed in nanometers.

In FIG. 6*a* are represented three optical carriers OC1, OC2,OC3 of distinct wavelengths $\lambda_1$, $\lambda_2$, $\lambda_3$ associated with three microwave-frequency modulations RF1,RF2,RF3. An optical carrier and its corresponding modulation are situated in the frequency lobe of one and the same channel C1,C2, C3. In the example of FIG. 6*a*, the spectral distance $\Delta_{OC\text{-}RF}$ between an optical carrier OC1 and its modulation RF1 is of the order of 19 GHz, the bandwidth of the modulation RF1 is of the order of 1 GHz and the optical carriers interleaving period, that is to say the spectral distance IP between two interleaved optical carriers OC1,OC3 is of the order of 100 GHz.

FIG. 6*b* presents an alternative to the spectral arrangement of FIG. 6*a* making it possible to optimize the overall spectral occupancy.

This time, an optical carrier OC1 and its corresponding modulation RF1 are situated in the frequency lobes of two distinct channels C1,C3. In this manner, by preserving the same orders of magnitude for the spectral distance $\Delta_{OC\text{-}RF}$ between an optical carrier OC1 and its modulation RF1, the value of the interleaving period IP is appreciably decreased, going, in the numerical example of FIG. 6*b*, from 100 GHz to 25 GHz.

Figure 7A:
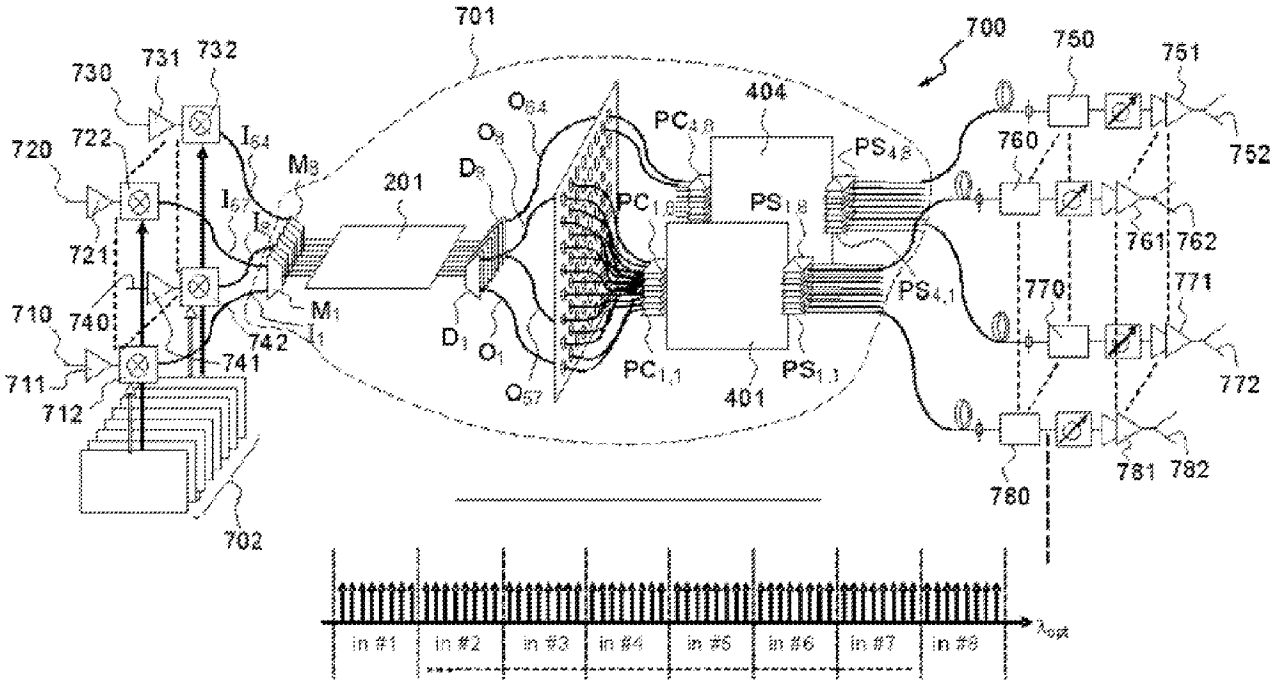

FIG. 7A represents a diagram of an antenna beamforming array 700 comprising a distributed feeding device 701 according to the invention.

By way of illustration, the antenna beamforming array 700 described in FIG. 7A is adapted for feeding 64 antennal elements 752,762,772,782 and comprises a distributed feeding device 701 according to the invention with 64 inputs and 64 outputs. The device according to the invention 701, shown schematically in FIG. 7A, corresponds to the second variant embodiment of the invention described in FIG. 4, that is to say that which requires five distributed feeding circuits 201,401,404. It can however be replaced with any of the variants presented in the description.

Each input I1, . . . I64 is connected to an optical modulator 712,722,732,742 for example a Mach-Zehnder modulator, which receives on an input an electrical or microwave-frequency signal 710,720,730,740 previously optionally amplified by way of an amplifier 711,721,731,741. The second input of each optical modulator 712,722, 732,742 is connected to a generator of optical carriers 702 which is able to generate at least one optical carrier of wavelength λ1. Advantageously, the generator 702 is able to generate as many optical carriers as inputs of the distributed feeding device 701. For example, the generator 702 may be able to implement a wavelength multiplexing technique, or "wavelength division multiplexing", so as to generate, in the example of FIG. 7A, 64 carriers of distinct wavelengths λ1, . . . λ64 such as is illustrated in the bottom diagram of FIG. 7A. Each optical carrier thus modulates the microwave-frequency signal produced on one of the inputs of the device 701.

The signal obtained on each of the outputs O1, . . . O64 of the device 701 is thereafter demodulated by way of an optical detector 750,760,770,780 for example a photo-detector, which is able to convert the optical signal into an electrical signal which is thereafter optionally amplified by way of amplifiers 751,761,771,781 before being conveyed to the radiating elements 752,762,772,782 of the antennal array to be fed.

Figure 7B:
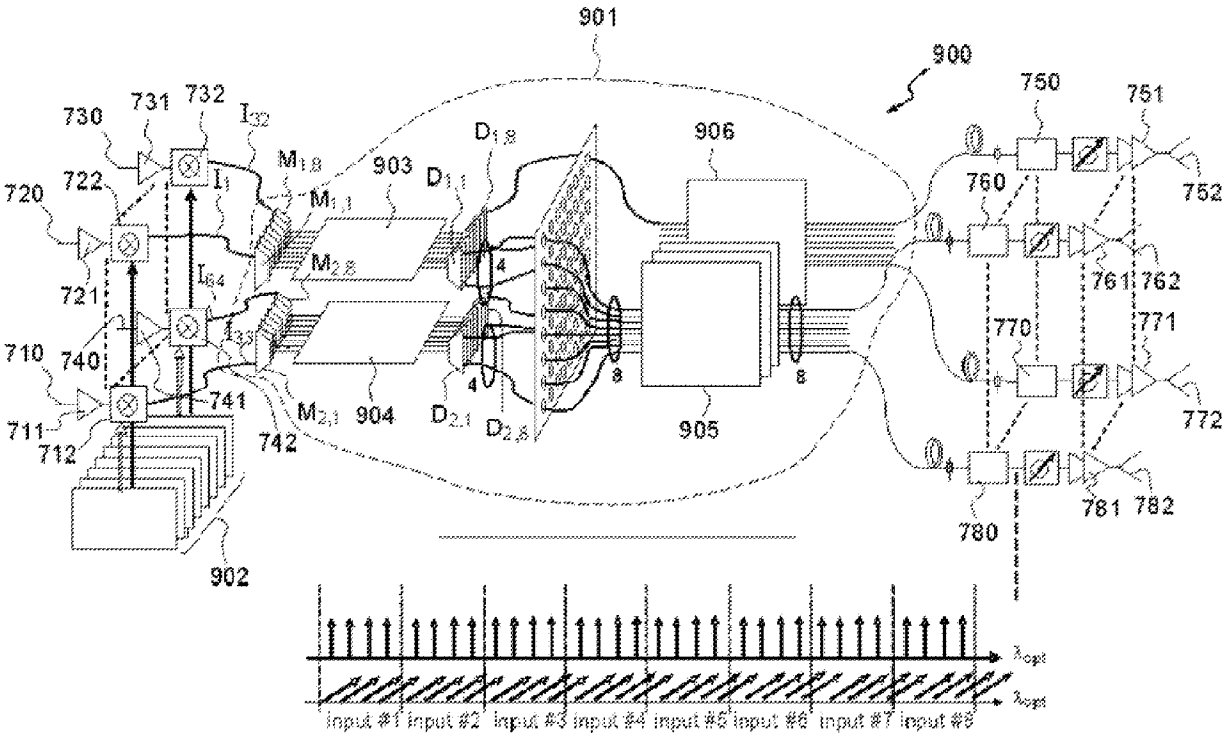

FIG. 7B represents a diagram of a second variant embodiment of an antenna beamformer according to the invention. The elements common to the systems of FIGS. 7 and 7*b* is are numbered with identical references.

According to this second variant, the antenna beamformer 900 is also adapted for feeding 64 antennal elements 752, 762,772,782 of an antennal array. Instead of the 64 optical carriers required to feed the system of FIG. 7A, the former according to FIG. 7B requires the generation of only 32 optical carriers by one or more generators 902. Each optical carrier is split into two halves to feed the 64 optical modulators 712,722,732,742 which receive, just as for the example of FIG. 7A, 64 microwave-frequency signals 710, 720,730,740. The system according to FIG. 7B furthermore comprises a distributed feeding device 901 according to the invention composed of two single-polarization distributed feeding circuits 903,904 each connected, by their inputs, to 8 multiplexers M1,1, . . . M1,8 . . . M2,1 . . . M2,8 with four inputs and one output and by their outputs to 8 demultiplexers D1,1, . . . D1,8 . . . D2,1 . . . D2,8 with one input and four outputs. Each distributed feeding circuit 903,904 is fed by one of the two sets of optical carriers obtained by splitting the 32 initial optical carriers.

The system 900 according to FIG. 7B furthermore comprises eight dual-polarization distributed feeding circuits 905,906, each connected, by four of its eight inputs, to an output of a demultiplexer of the first single-polarization distributed feeding circuit 903 and, by its other four inputs, to an output of a demultiplexer of the second single-polarization distributed feeding circuit 904.

During the interconnections between the outputs of the demultiplexers connected to either one 904 of the two single-polarization distributed feeding circuits 903,904, and the corresponding inputs of the two dual-polarization distributed feeding circuits 905,906, the polarization of the optical signals is modified, for example rotated by 90°, so as to guarantee that they will pass through these circuits 905, 906 independently of the signals originating from the other single-polarization distributed feeding circuit 903, which for their part have not undergone any modification of polarization. It is indeed well known that perpendicular polarizations, for example a first vertical polarization and a second horizontal polarization, propagate without mixing in an optical device adapted for transmitting these two polarizations.

The assembly 901 composed notably of the 10 distributed feeding circuits 903,904,905,906 constitutes a distributed feeding device according to a variant of the invention which is not described but which ensues directly from the numerous examples already described in FIGS. 2, 3, 4 and 5.

A variant embodiment is now described of the device according to the invention such as described in FIG. 2 which presents the advantage of no longer being limited to an identical number of inputs and of outputs but which can be broadened on the contrary to a device with P×N inputs and Q×M outputs where P, N, Q and M are strictly positive integers.

This variant of the invention is applicable in the case where the distributed feeding circuits 201,203 used to embody the device according to the invention are no longer limited to equal numbers of inputs and outputs. This typical case finds application notably when the distributed feeding circuit used is no longer a Butler matrix but is a circuit with P inputs and N outputs, with P different from N, as is the case for Blass matrices, Rotman lenses or formers of "Pillbox" type. These various circuits are customarily used in the field of antenna beamformers and are consequently known to the person skilled in the art and are not described here. Exemplary implementations of such circuits in RF technology are notably described in the references [1], [2], [3] and [4]. Exemplary implementations in opto-electronic technology are also given in references [5] and [6].

Figure 8:
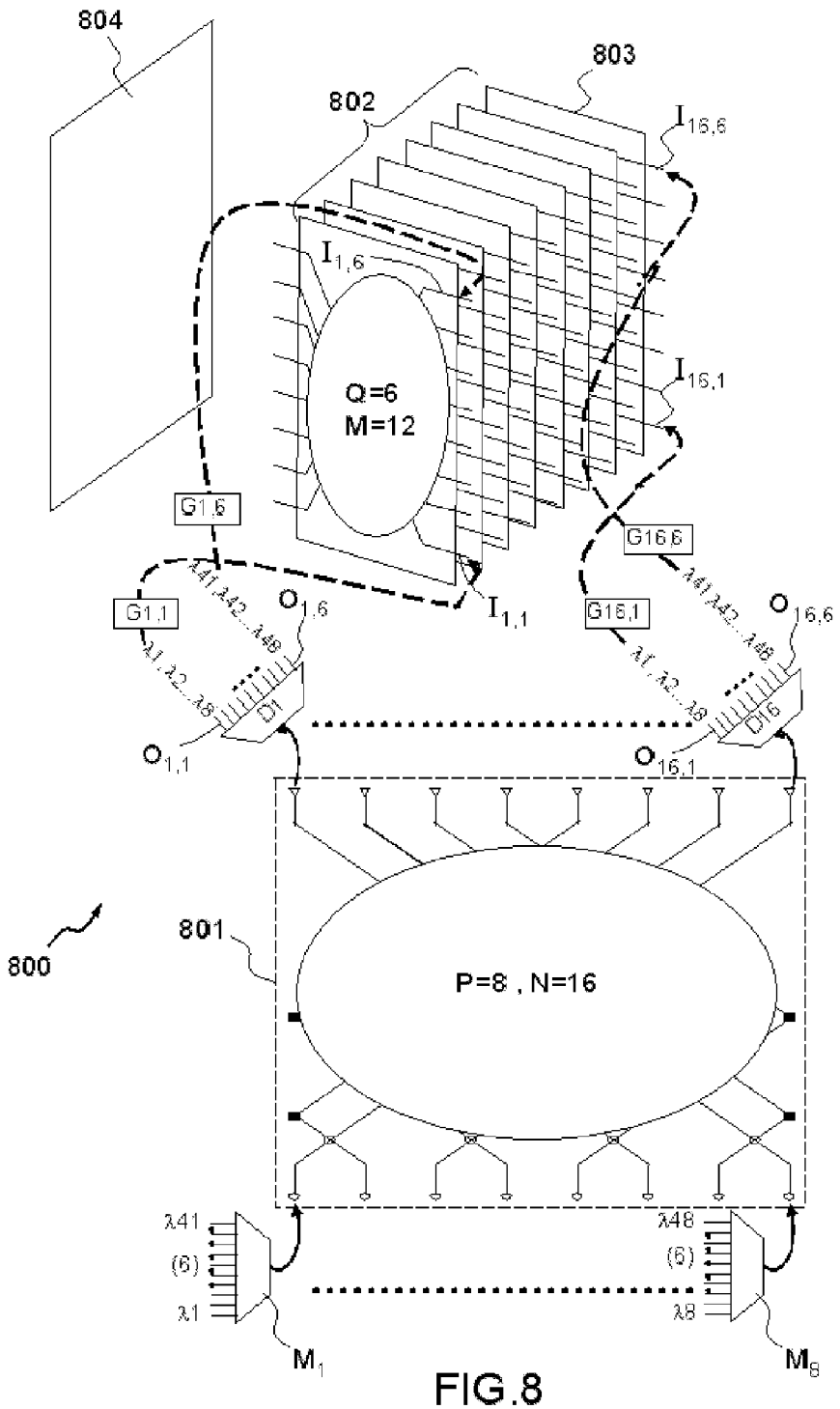

FIG. 8 illustrates, in an example, a broadening of the device according to the invention, such as described in FIG. 2, in the case where the distributed feeding circuits used are devices of the type described hereinabove.

In the example of FIG. 8, the distributed feeding device 800 according to the invention comprises 8*6=48 inputs and 12*16=192 outputs. It is therefore adapted for the generation of 48 orthogonal antenna beams (carrying the signals injected on each of the 48 inputs), by combining the radiation of 192 elements of the array antenna.

The device 800 of FIG. 8 is composed of the same elements as the device 200 of FIG. 2 but in different numbers.

More precisely, the device 800 according to the invention comprises a first distributed feeding circuit 801, with P=8 inputs and N=16 outputs. The circuit 801 is, for example, a circuit of the Blass matrix, Rotman lens or "Pillbox" former type.

Each input of the first circuit 801 is linked to the output of a frequency multiplexer M1, . . . M8 and each output of the first circuit 801 is linked to the input of a frequency demultiplexer D1, . . . D16. In total, 8 multiplexers and 16 demultiplexers are thus required.

A multiplexer M1, . . . M8 comprises 6 distinct inputs for receiving 6 signals transmitted on eight distinct carriers and an output, connected to an input of the first circuit 801. Its function consists, just as for the device of FIG. 2, in multiplexing a plurality of signals (in this instance 6) on distinct carriers into a multi-carrier single signal.

A frequency demultiplexer D1, . . . D16 comprises an input, connected to an output of the first distributed feeding circuit 801, and six outputs for delivering six signals on distinct carriers, on the basis of the multi-carrier input signal.

Each output $O_{1,1}$, $O_{1,6}$, $O_{16,1}$, $O_{16,6}$ of a frequency demultiplexer is connected to a distinct input $I_{1,1}$, $I_{1,6}$, $I_{16,1}$, $I_{16,6}$ of an assembly 802 of sixteen distributed feeding circuits 803 with six inputs and twelve outputs each.

The device according to the invention presented in FIG. 8 thus comprises 17 distributed feeding circuits 801,803. It is adapted for feeding an antennal array 804 comprising at most 192 radiating elements.

The arrangement of the optical carriers on the various inputs of the multiplexers M1, . . . M8 is carried out in the same manner already described for FIGS. 2 and 3.

The variant embodiments of the invention, described in FIGS. 4 and 5, are also applicable to the cases of the circuits of the Blass matrix, Rotman lens or "Pillbox" former type and are readily deduced from the example of FIG. 8 in the same manner as the examples of FIGS. 4 and 5 are deduced from the example of FIG. 2.

The device 800 according to the invention can therefore be generalized to any device comprising P×Q inputs and N×M outputs, with P, N, Q and M strictly positive integers. For the variant of the invention presented in FIG. 8, the device according to the invention comprises a first distributed feeding circuit with P inputs and N outputs, an assembly of N second distributed feeding circuits with Q inputs and M outputs, P frequency multiplexers with Q inputs and one output and N frequency demultiplexers with one input and Q outputs.

According to the second variant embodiment of the invention presented in FIG. 4 and broadened to circuits other than Butler matrices, the number of second distributed feeding circuits of the said assembly is halved.

Finally, the third variant embodiment of the invention presented in FIG. 5 and broadened to circuits other than Butler matrices requires only two distributed feeding circuits, the first with P inputs and N outputs, the second with Q inputs and M outputs.

REFERENCES

[1]: Robert J. Mailloux "Phased Array antenna handbook" (Artech House, 1993).

[2]: Nelson Fonseca: Thesis report, Université de Toulouse, October 2011

[3]: Rao S. K. et al [Boeing]: "Reconfigurable Multiple Beam Satellite Phased Array Antenna," U.S. Pat. No. 5,936,588, August 1999

[4]: Cheng et al (Univ. Montreal, Canada): "Millimeter-Wave Substrate Integrated Waveguide Multibeam Antenna Based on the Parabolic Reflector Principle" IEEE AP Transactions, September 2008

[5]: Y. Chen, and R. T. Chen, "A Fully Packaged True Time Delay Module for a K-band Phased Array Antenna System Demonstration", IEEE Photonics Technology Letters, Vol. 14, No. 8, August 2002, pp. 1175-1177.

[6]: Z. Zalevsky, S. Zach and M Tur, "A Novel Photonic Rotman-Lens Design for Radar Phased Array", IEEE International Conference on Microwaves, Communications, Antennas and Electronics Systems 2009, COMCAS 2009, Tel Aviv, Israel, 9-11 Nov. 2009, pp. 1-4.

The invention claimed is:

1. A distributed feeding apparatus for antenna beamforming, comprising:

a first distributed feeding circuit comprising a plurality P of inputs and a plurality N of outputs, the first distributed feeding circuit being configured for producing, when a signal is injected on one of the P inputs, a signal on each of the N outputs with a phase shift which is approximately constant between two adjacent outputs among the N outputs, at least one frequency multiplexer connected to at least one input of the said first circuit, a number, equal to the number N of outputs of the said first distributed feeding circuit, of frequency demultiplexers each connected in input, to an output of the said first distributed feeding circuit, and a second distributed feeding device comprising a plurality of inputs, each connected to an output of one of the said frequency demultiplexers, and a plurality of outputs, the said second distributed feeding device comprising:

at least one second distributed feeding circuit comprising a plurality Q of inputs and a plurality M of outputs, the second distributed feeding circuit being configured for producing, when a signal is injected on one the Q inputs, a signal on each of the M outputs with a phase shift which is approximately constant between two adjacent outputs among the M outputs.

2. The distributed feeding apparatus according to claim 1, in which a frequency multiplexer is configured to multiplex a plurality of signals on distinct optical carriers.

3. The distributed feeding apparatus according to claim 2, in which a frequency demultiplexer is configured to demultiplex a plurality of optical carriers into at least one group of carriers comprising one of the optical carriers produced on each input of the said first distributed feeding circuit.

4. The distributed feeding apparatus according to claim 2, in which the said second distributed feeding device comprises a single distributed feeding circuit having Q inputs and M outputs which is configured for producing, when a signal is injected on one of the Q inputs, a signal on each of the M outputs with a phase shift which is approximately constant between two adjacent outputs, a frequency translating device for translating the optical signals delivered by each frequency demultiplexer so that they occupy different frequency bands, at least one second frequency multiplexer for multiplexing together the signals, delivered by each of the said frequency demultiplexers, emitted on the same optical carriers, and at least one second frequency demultiplexer (D'1, . . . D'8), connected to an output of the said single feeding circuit, for demultiplexing the frequency-translated signals.

5. The distributed feeding apparatus according to claim 4, in which the said frequency bands are adjacent.

6. The distributed feeding apparatus according to claim 4, in which the said second distributed feeding device furthermore comprises:

a first polarization handling device for modifying the polarization of the signals delivered by a first frequency demultiplexer so that the signals delivered by two distinct first demultiplexers are polarized differently, and a second polarization handling device for modifying the polarization of the signals delivered at the output of the said distributed feeding circuit so that they all have the same polarization.

7. The distributed feeding apparatus according to claim 1, in which the second distributed feeding device comprises a number of inputs equal to Q multiplied by N and a number of outputs equal to M multiplied by N, each of the inputs of the second distributed feeding device being connected to a different output of a frequency demultiplexer.

8. The distributed feeding apparatus according to claim 1, in which the said second distributed feeding device comprises a number equal to N of second distributed feeding circuits having Q inputs and M outputs, configured for producing, when a signal is injected on one of the Q inputs, a signal on each of the M outputs with a phase shift which is approximately constant between two adjacent outputs, each of the said second feeding circuits being connected, by Q inputs, to Q outputs of one and the same frequency demultiplexer.

9. The distributed feeding apparatus according to claim 1, in which the said second distributed feeding device comprises a number equal to N/2 of second distributed feeding circuits with having Q inputs and M outputs, configured for producing, when a signal is injected on one of the Q inputs, a signal on each of the M outputs with a phase shift which is approximately constant between two adjacent outputs, the said second feeding device furthermore comprising at least one polarization-combining element connected, in output, to an input of one of the said second distributed feeding circuits and being configured to combine a first signal delivered by an output of a first frequency demultiplexer having a first polarization and a second signal delivered by an output of a second frequency demultiplexer having a second polarization, different from the first polarization, the said second feeding device furthermore comprising at least one polarization-separating element connected, in input, to an output of one of the said second distributed feeding circuits and being able to separate a first signal having a first polarization from a second signal having a second polarization, different from the first polarization.

10. The distributed feeding apparatus according to claim 9, in which the second polarization is orthogonal to the first polarization.

11. The distributed feeding apparatus according to claim 10, in which the first polarization is horizontal and the second polarization is vertical.

12. The distributed feeding apparatus according to claim 1, in which the theoretical transfer function of the said first distributed feeding circuit and the said second distributed feeding circuit is an orthogonal or unit matrix.

13. The distributed feeding apparatus according to claim 1, furthermore comprising a second distributed feeding circuit paired with the first distributed feeding circuit and configured with different polarization from that of the said first distributed feeding circuit.

14. The distributed feeding apparatus according to claim 1, in which the said first distributed feeding circuit and the said second distributed feeding circuit are of the Blass matrices or Rotman lenses or "Pillbox" devices type.

15. The distributed feeding apparatus according to claim 1, in which the number of inputs P and the number of outputs N of the first distributed feeding circuit are equal to one another and equal to the number of inputs Q and to the number of outputs M of a second distributed feeding circuit of the second distributed feeding device.

16. The distributed feeding apparatus according to claim 15, in which the said first distributed feeding circuit and the said second distributed feeding circuits are of the Butler matrix type.

17. The distributed feeding apparatus according to claim 1, in which the said first distributed feeding circuit and the said second distributed feeding circuit are optical integrated circuits.

18. The distributed feeding apparatus according to claim 1, in which the said first distributed feeding circuit is disposed in a plane substantially orthogonal to the plane of the said second distributed feeding circuit.

19. An antenna beamforming array comprising a distributed feeding apparatus for antenna beamforming, comprising:

a first distributed feeding circuit comprising a plurality P of inputs and a plurality N of outputs, the first distributed feeding circuit being configured for producing, when a signal is injected on one of the P inputs, a signal on each of the N outputs with a phase shift which is approximately constant between two adjacent outputs among the N outputs, at least one frequency multiplexer connected to at least one input of the said first circuit, a number, equal to the number N of outputs of the said first distributed feeding circuit, of frequency demultiplexers each connected in input, to an output of the said first distributed feeding circuit, and a second distributed feeding device comprising a plurality of inputs, each connected to an output of one of the said frequency demultiplexers, and a plurality of outputs, the said second distributed feeding device comprising:

at least one second distributed feeding circuit comprising a plurality Q of inputs and a plurality M of outputs, the second distributed feeding circuit being configured for producing, when a signal is injected on one the Q inputs, a signal on each of the M outputs with a phase shift which is approximately constant between two adjacent outputs among the M outputs, the distributed feeding apparatus being for feeding at least one antennal element of an antenna array.

20. The antenna beamforming array according to claim 19, comprising a first modulator for modulating at least one electrical signal at a microwave frequency on an optical carrier and injecting the modulated signal on at least one input of the said distributed feeding device and a second receiver for receiving at least one signal produced on at least one of the outputs of the said distributed feeding apparatus and converting it into an electrical signal intended to feed at least one antennal element of an antenna array.

21. The antenna beamforming array according to claim 20, in which the optical carriers intended to be injected at the input of the said distributed feeding device are grouped together, each group of carriers being injected on the inputs of a distinct multiplexer, a group comprising a plurality of adjacent carriers or a plurality of equidistributed carriers in the total band occupied by the carriers as a whole.

* * * * *